US010017845B2

(12) United States Patent
Goedel et al.

(10) Patent No.: US 10,017,845 B2
(45) Date of Patent: Jul. 10, 2018

(54) CYLINDER LINER AND METHOD FOR PRODUCING SAME

(71) Applicant: Federal-Mogul Burscheid GmbH, Burscheid (DE)

(72) Inventors: Peter Goedel, Freienried (DE); Volker Scherer, Cologne (DE); Michael Buchmann, Munich (DE)

(73) Assignee: Federal-Mogul Burscheid GmbH, Burscheid (DE)

( * ) Notice: Subject to any disclaimer, the term of this patent is extended or adjusted under 35 U.S.C. 154(b) by 0 days.

(21) Appl. No.: 14/419,430

(22) PCT Filed: Apr. 29, 2013

(86) PCT No.: PCT/EP2013/058857
§ 371 (c)(1),
(2) Date: Feb. 3, 2015

(87) PCT Pub. No.: WO2014/019723
PCT Pub. Date: Feb. 6, 2014

(65) Prior Publication Data

US 2015/0218687 A1 Aug. 6, 2015

(30) Foreign Application Priority Data

Aug. 3, 2012 (DE) ..... 10 2012 015 405

(51) Int. Cl.
*B22D 19/00* (2006.01)
*B22D 19/16* (2006.01)
(Continued)

(52) U.S. Cl.
CPC ..... *C23C 4/185* (2013.01); *B22D 19/0009* (2013.01); *B22D 19/16* (2013.01);
(Continued)

(58) Field of Classification Search
CPC ..... C23C 4/185; C23C 4/067; C23C 4/02; C23C 4/18; C23C 4/08; C23C 30/00; B22D 21/04; B22D 23/003; B22D 19/0009; B22D 19/16; F02F 1/004; Y10T 29/49272; Y10T 29/49705; Y10T 29/4998; Y10T 29/49982; Y10T 29/49984; Y10T 29/49988; Y10T 29/49989
(Continued)

(56) References Cited

U.S. PATENT DOCUMENTS 2,202,118 A * 5/1940 Newman ..... D01G 99/00 174/124 G
2,280,248 A * 4/1942 Meiswinkel ..... F02D 1/00 123/387
(Continued)

FOREIGN PATENT DOCUMENTS

DE 10308562 B3 8/2004
DE 102008013813 A1 9/2009
(Continued)

*Primary Examiner* — Bayan Salone
(74) *Attorney, Agent, or Firm* — Robert L. Stearns; Dickinson Wright, PLLC

(57) ABSTRACT

The invention relates to a method for producing a thermally sprayed, thin-walled cylinder liner for insertion into a cylinder crankcase and to a cylinder liner produced with said method.

12 Claims, 1 Drawing Sheet

(51) Int. Cl.

| | |
|---|---|
| ***C23C 4/02*** | (2006.01) |
| ***C23C 4/06*** | (2016.01) |
| ***C23C 4/08*** | (2016.01) |
| ***C23C 4/18*** | (2006.01) |
| ***C23C 30/00*** | (2006.01) |
| ***B22D 21/04*** | (2006.01) |
| ***B22D 23/00*** | (2006.01) |
| ***F02F 1/00*** | (2006.01) |
| ***C23C 4/067*** | (2016.01) |

(52) U.S. Cl.
CPC ..... *B22D 21/04* (2013.01); *B22D 23/003* (2013.01); *C23C 4/02* (2013.01); *C23C 4/067* (2016.01); *C23C 4/08* (2013.01); *C23C 4/18* (2013.01); *C23C 30/00* (2013.01); *F02F 1/004* (2013.01); *Y10T 29/49272* (2015.01)

(58) Field of Classification Search
USPC ..... 29/527.1–527.3, 527.5, 527.6, 458; 164/46
See application file for complete search history.

(56) References Cited

U.S. PATENT DOCUMENTS 3,461,009 A * 8/1969 Snyder ..... B29C 33/0011 156/242
3,539,192 A * 11/1970 Prasse ..... F16J 9/22 277/444
3,561,104 A * 2/1971 Holton et al. ..... F16J 10/04 164/76.1
4,447,275 A * 5/1984 Hiraoka ..... F01P 11/06 123/41.72
6,044,820 A * 4/2000 Domanchuk ..... C23C 4/185 123/193.2
6,182,629 B1 * 2/2001 Gobbels ..... B22D 19/0009 123/193.2
6,409,897 B1 * 6/2002 Wingo ..... C23C 14/3407 204/298.12
7,073,492 B2 * 7/2006 Hoffmann ..... F02F 1/004 123/193.2
7,150,309 B2 * 12/2006 Newcomb ..... B22D 19/0009 164/332
7,191,770 B1 * 3/2007 Anderson ..... F02F 1/004 123/193.2
7,291,384 B2 * 11/2007 Obara ..... C23C 4/06 427/455
7,543,557 B2 * 6/2009 Wang ..... F02F 1/18 123/193.1
7,617,805 B2 * 11/2009 Highum ..... B22D 19/0081 123/193.2
7,726,273 B2 * 6/2010 Azevedo ..... F02F 1/20 123/193.2
2005/0170099 A1 * 8/2005 Gadow ..... C23C 4/12 427/446
2005/0199196 A1 * 9/2005 Azevedo ..... F02F 1/20 123/41.84
2006/0040125 A1 * 2/2006 Obara ..... C23C 4/06 428/556
2006/0048911 A1 * 3/2006 Newcomb ..... B22D 19/0009 164/98
2007/0000129 A1 * 1/2007 Hahn ..... C23C 4/02 29/888.011
2007/0261767 A1 * 11/2007 Jarosinski ..... C22C 27/04 148/320
2008/0244891 A1 * 10/2008 Iizumi ..... B23B 27/007 29/527.4
2010/0139607 A1 * 6/2010 Herbst-Dederichs ..... C23C 4/02 123/193.2

FOREIGN PATENT DOCUMENTS

DE 102008053642 A1 5/2010
DE 102010053029 A1 6/2012
EP 1967601 A2 9/2008

* cited by examiner

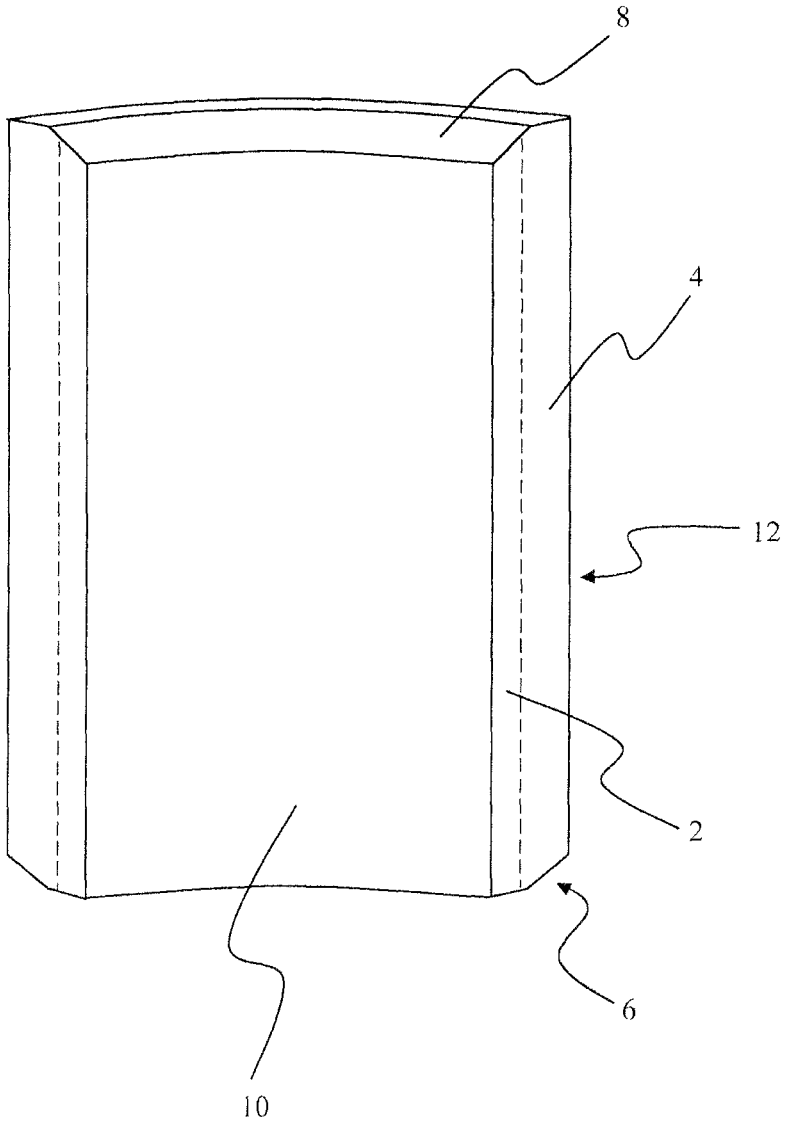
8
4
12
2
6
10

CYLINDER LINER AND METHOD FOR PRODUCING SAME

BACKGROUND OF THE INVENTION

1. Technical Field

The present invention relates to a method for producing an in particular thermally sprayed, thin-walled cylinder liner for insertion into a cylinder crankcase and to a cylinder liner produced with said method.

2. Related Art

In engines without cylinder liners, a material must be used for the engine block that meets the primary requirements arising owing to direct contact with the friction partners of pistons and piston rings. In particular, high wear resistance and low friction are necessary. Of secondary importance are further requirements such as low weight, low material costs, low production costs and high thermal conductivity. Said requirements can be reconciled in linerless engines only with difficulty, if at all.

The use of cylinder liners in internal combustion engines makes it possible to use for the engine block a different material that meets only the critical requirements of the same. The cylinder liner however can be optimised specifically for the requirements of wear resistance and low friction. Since the proportion of material of the liner is relatively low compared to the engine block, materials of higher quality and therefore higher cost can also be used here without having too great a negative effect on total costs.

Methods for producing lightweight metal cylinder liners for thermal joining in cylinder crankcases consisting of iron or lightweight metal are known from the prior art (see for instance the brochure "Overhauling aluminium engines" from the company MSI Motor Service International GmbH, Issue 03/99). Such liners are produced e.g. by a process of spray compaction with subsequent machining. These liners, marketed under the brand name Alusil®, have however the disadvantage of a modest wear resistance on the cylinder running surface. Furthermore, a complex process of exposing silicon crystals is in this case necessary during final treatment of the cylinder running faces.

Aluminium-silicon cylinder liners marketed under the brand name Silitec® or cylinder running faces consisting of block alloys (Alusil®, Lokasil®) have high thermal conductivity. The wear resistance of the respective cylinder running faces is determined by the silicon particles present that project outwards after honing. With cast materials, a silicon content of no more than approximately 20% can be achieved by the process. Higher silicon contents can be achieved with spray-compacted materials, but this results in increasing component costs for process engineering reasons. Owing to the high mechanical loading in new engines, for example petrol engines having direct fuel injection or modern diesel engines, the mechanical strength values with conventional aluminium-silicon alloys are however marginal.

Furthermore, slip-fit liners consisting of grey cast iron are known as cylinder liners. The liners are manufactured mechanically from spun grey cast iron tubes. To achieve the required surface roughness and cylinder shape, the outer diameter is ground. To insert grey cast iron liners, it is necessary for the liner to have a larger diameter at room temperature than the bore of the cylinder crankcase. Then the diameter of at least one of the two bodies to be joined must be changed by thermal expansion in such a manner that the liner can be inserted securely into the cylinder crankcase. This generally takes place by heating the cylinder crankcase, since cooling of the liner alone is not sufficient owing to the inadequate thermal expansion coefficient of grey cast iron. This makes the insertion of grey cast iron liners complex and expensive.

Layers sprayed onto the cylinder running face are another known form of cylinder protection. DE 197 33 205 A1 discloses a coating of a cylinder running face of a piston engine based on iron, aluminium or magnesium, containing a hypereutectic aluminium-silicon alloy and/or an aluminium-silicon composite material, and a method for producing said coating. The coating is in this case applied directly to the inner wall of the cylinder bore in the engine block.

To this end, either an internal burner, which is attached to a rotating assembly and rotates about the centre axis of the cylinder bore, is introduced into the cylinder bore and moved axially, or the internal burner is introduced into the cylinder bore of the rotating crankcase and moved axially along the centre axis of the cylinder bore in order to spray the coating onto the cylinder wall. The cylinder surface must generally be prepared in a complex manner before coating, for example by roughening by means of high-pressure water jets or by introducing a defined profile with undercut sections by means of a turning process.

The production of the coating directly on the wall of the cylinder bore also requires either a complicated assembly having an internal burner, which itself rotates inside the bore in order to be able to apply the coating evenly, or it is necessary for the entire engine block with the cylinder bore to be rotated about a non-rotating internal burner. Both methods are complex and cost-intensive. Owing to the size of the coating assembly, only cylinder bores having a bore diameter of more than 80 mm can be coated reliably.

It is therefore the object of the present invention to provide a simpler method for producing an improved cylinder liner and a corresponding liner, with which the disadvantages listed above can be eliminated or at least reduced.

SUMMARY OF THE INVENTION

According to a first aspect of the invention, a method is provided for producing a cylinder liner, comprising: thermal spraying of a first material onto a mould body to form a wear- and corrosion-resistant first layer, the first sprayed material comprising at least 67% iron, Fe; no more than 3% carbon, C; between 0 and no more than 20% chromium, Cr; between 0 and no more than 10% nickel, Ni; and thermal spraying of a second material to form a second, outer layer on the first, inner layer, the second sprayed material comprising aluminium, an aluminium alloy or a multi-element material consisting of lightweight material and iron.

BRIEF DESCRIPTION OF THE DRAWING

FIG. 1 shows a section of a cylinder liner according to one embodiment of the invention.

DETAILED DESCRIPTION OF THE INVENTION

A method for producing a cylinder liner 10 by means of thermal spraying is described below.

In the method, a first material is provided to form a first, inner layer 2 on a mould body, said material containing at least 67% Fe and no more than 3.0% C as essential elements. To improve the corrosion resistance of the first layer 2, up to 20% Cr and/or 10% nickel can be added to the alloy.

In a preferred embodiment, the first material contains at least 70% Fe, more preferably at least 80% Fe, even more preferably at least 90% Fe and further preferably at least 95% Fe. The carbon content should not be more than 3%, as otherwise the material is too hard and brittle and therefore difficult to work. There is a risk of layers flaking off or cracks forming. The carbon content is therefore preferably ≤2% and even more preferably ≤1%.

The material can also contain between 0 and no more than 30% Cr and between 0 and no more than 10% Ni. These components normally serve to increase corrosion resistance but also mean higher material costs and higher manufacturing outlay for the post-machining of the running face e.g. by honing. However, it has been found that the first, inner layer of the cylinder liner produced according to the invention in this step exhibits no susceptibility to corrosion in current engine designs, even without the presence of the elements mentioned, so the material used only has to contain said elements in small amounts, if at all. Preferred ranges for said components are between 0 and 19%, more preferably between 0 and 5%, more preferably between 0 and 3%, even more preferably between 0 and 1% for Cr. Similarly, a range for Ni is preferably between 0 and 5%, more preferably between 0 and 3%, yet more preferably between 0 and 2%, even more preferably between 0 and 1%.

The material is present as solid or flux-cored wire before the coating process and is melted and applied to a rotating mould body by means of known wire-coating methods such as arc wire spraying or wire flame spraying or the like.

The material is applied to the outer face of the rotating mould body, which has a substantially cylindrical shape. With the proviso of the cylindrical shape, the further shape of the mould body, in particular the dimensions thereof, is only limited by the intended field of use. For instance, in particular the outer diameter of the mould body can be, in view of the different diameters of cylinder liners, within the range from approx. 20 mm to approx. 1000 mm, preferably between 60 mm and approx. 100 mm for the automotive field. The length of the mould body is upwardly unlimited, since a desired length of the cylinder liner can be produced by post-machining an initially obtained workpiece. The mould body only has to have the length of the desired cylinder liner and can therefore be from approx. 50 mm to approx. 5 m. For the production of cylinder liners for the automotive sector, the length of the mould body is from approx. 100 mm to approx. 400 mm, it being possible to produce 2 to 4 cylinder liners at once on one mould body.

The mould body can consist of any material that remains dimensionally stable under the applied process conditions, i.e. can withstand in particular the temperatures of the melted and applied material, for example temperatures of approx. 1400° C. for iron, and allows the first, inner layer to be detached after application. The outer face of the mould body can optionally be provided with a thin, inorganic separation layer.

In a further step, a second, outer layer 4 is applied to the first, inner layer, which can still be on the mould body or can have been removed from the mould body beforehand, i.e. is present as a free body in the form of a sleeve. The outer diameter of the first layer is "as sprayed", i.e. it is not machined before the second layer is applied.

The same thermal spraying method as in the first step or a different one can be used. This is selected depending on the material used and the other conditions prevailing during production.

The material applied in the second step is generally selected such that it has a thermal expansion coefficient that is as similar as possible to that of the cylinder crankcase. The material can for example be selected from aluminium or an aluminium alloy consisting of Al and Si or Al and Mn or Al and Mg or a multi-element layer consisting of an aluminium alloy and iron. This is particularly advantageous since such a combination is distributed in points over the surface during application, which provides lower surface roughness for a subsequent machining step, in particular grinding.

Layers having a porosity of <8% by volume, preferably <5% by volume, more preferably <3% by volume, and pore sizes of <15 μm, preferably <10 μm, more preferably <8 μm, can be achieved with the method according to the invention. This is much improved compared to inner coatings of the prior art, which provide a porosity of approximately >10% by volume and a pore size of approximately 20 μm.

If the second application step has been carried out on the mould body, the product so obtained can be left on the mould body or removed from the mould body before further processing steps.

According to a preferred embodiment of the method, the outer lateral surface 12, which is still rough after spraying, of the outer, second layer is machined by grinding or turning, as a result of which the desired outer diameter, the necessary cylindricity and the required surface roughness of the cylinder liner produced with the method according to the invention are achieved. The roughness depth (Rz) to be produced of the outer lateral surface is normally within the range of at most approximately 50 preferably at most approximately 30 μm, more preferably at most 10 μm. The desired roughness depth can be achieved in each case by a suitable machining method such as fine-turning. If greater demands are made of the cylindricity, the outer lateral surface can also be ground.

The desired total length of the cylinder liner to be inserted into an engine can be produced by turning, milling or laser-cutting out of the cylinder liner produced.

According to one embodiment, the first, inner layer 2 of the cylinder liner 10 produced with the method according to the invention has a layer thickness of approximately 0.2 to 2.0 mm, preferably of 0.2 to 1 mm, more preferably of 0.2 to 0.8 mm. The second, outer layer 4 of the cylinder liner 10 produced with the method according to the invention has, after application, a layer thickness of approximately 0.2 to 2 mm, preferably of 0.3 to 2.0 mm, yet more preferably of 0.3 to 1.0 mm. The layer thickness of the outer layer is generally reduced by the machining steps of turning and/or grinding by approximately 0.1 mm to approximately 0.5 mm.

Consequently, the cylinder liner produced with the method according to the invention has a total wall thickness of 0.4 to no more than approximately 10 mm, preferably from approximately 1 mm to 2 or 3 mm.

The product obtained in this manner, if it is still on the mould body, is then removed from the latter for optional further treatment.

According to one embodiment, the method further comprises providing the cylinder liner produced with the method according to the invention with a bevel 6 on the outer diameter and/or inner diameter 8 at one or both axial ends. This not only makes it easier to join the liner, but also improves positioning of a honing tool for internal machining.

According to a further embodiment, the method further comprises providing cut-outs and/or overflow channels on the liner jacket, which can be produced by machining with geometrically defined cutting edges or thermal laser-cutting.

The cylinder liner produced with the method according to the invention can optionally be provided with pulsation bores or a collar at one end. The pulsation bores can be produced either by milling or by cutting with a laser; the collar can be produced for example by turning.

According to one embodiment, the method further comprises honing the inside of the formed cylinder liner after joining in the engine block, as a result of which the thickness of the first, inner layer can be reduced to as low as 0.05 mm in order to achieve better thermal conductivity.

According to a further aspect of the invention, a cylinder liner that has been produced by the above-described method is provided.

The cylinder liner produced with the method according to the invention is inserted into a cylinder bore of an engine after it has been completed and machined. This can take place in a conventional manner for example in the automotive field, by heating the engine block (aluminium) to a temperature of approx. 250° C. and introducing the liner into the cylinder bores. Owing to its intrinsic properties, however, the liner according to the invention can also be inserted into an engine block that has not been heated, by cooling the liner itself beforehand, for example to temperatures of approximately −20° C., or −30° C. or −40° C. as far as −78.5° C. (solid carbon dioxide) or preferably in liquid nitrogen to temperatures of approximately −20° C. etc. as far as −196° C. and then transferring it into the cylinder bore. This is not possible with a grey cast iron liner, since its expansion coefficient is too low. The liner according to the invention thereby makes handling easier and reduces the effort and cost of inserting the liner.

There are also advantages to a mechanical installation ("loose fit") of the cylinder liner according to the invention, since the aluminium-containing outer layer expands during operation and ensures better contact with the cylinder bore wall, with associated improved dissipation of heat. The liner is fixed axially in the cylinder bore at room temperature by means of the collar.

EXAMPLE

Arc wire spraying was used to spray a 0.8 mm-thick first layer from a steel wire (99% Fe, 0.8% C, remainder impurities such as Mn, Cr, Ni) onto a metallic cylindrical mould body (diameter 80 mm, length 1000 mm). The 3.2 mm-thick solid wires were melted in the coating assembly at a feed rate of 1 m/min, a voltage of 36 V and a current of 800 A and sprayed onto the mould body, which was rotating at 150 rpm. The coating distance was 150 mm; the layer thickness of 0.8 mm was applied in 6 coating paths.

The first layer was removed from the mould body, clamped between 2 conical holders and provided with a 1.0 mm-thick AlSil2 layer likewise by means of arc wire spraying in a second coating installation. The 3.2 mm solid wires were guided into the coating assembly at a feed rate of 1.2 m/min and melted at 30 V and 650 A. The 1.0 mm-thick layer is applied in 4 coating paths at a rotation speed of 150 rpm.

The layer structure of both layers was analysed by means of metallographic experiments; the hardness of the St0.8 layer was 400 HV1, the AlSi12 layer 100 HV1. In both layers the porosity was <3%, the maximum pore size was 10 μm.

The finished sprayed, cylindrical component having an inner diameter of 80 mm, a total length of 180 mm and a wall thickness of 1.8 mm was removed from the coating installation, clamped into a lathe and turned cylindrically on the outer jacket. The surface roughness was Ra <6 μm, the liner was turned to an outer diameter of 83.6 mm.

Finally, the cylinder liner was cut to 142 mm and provided with a 30° bevel inside and outside at both ends by turning.

The invention claimed is:

1. A method for producing a cylinder liner for thermally inserting into a cylinder crankcase, comprising:

thermal spraying of a first material onto an outer face of a rotating mold body which is formed of metal and has a substantially cylindrical shape to form a wear- and corrosion-resistant first layer, the first sprayed material comprising:

at least 80% iron, Fe;

no more than 2% carbon, C;

between 0 and no more than 20% chromium, Cr;

between 0 and no more than 1% nickel, Ni; and thermal spraying of a second material to form a second, outer layer on the first, inner layer, the second sprayed material comprising:

aluminium, an aluminium alloy or a multi-element material consisting of an aluminium alloy and iron; and removal of the mold body.

2. The method according to claim 1, further comprising:

processing of the outer layer by grinding or fine or ultra-fine turning.

3. The method according to claim 1, wherein the maximum roughness depth of an outer lateral surface of the cylinder liner is 50 μm.

4. The method according to claim 1, wherein each layer has a layer thickness of 0.05 to 2.0 mm.

5. The method according to claim 1, wherein the cylinder liner formed has a maximum total wall thickness of 4.0 mm.

6. The method according to claim 1, further comprising:

providing the cylinder liner with opposite axial ends and formed with a bevel on an outer rim at one or both axial ends of the cylinder liner.

7. The method according to claim 1, further comprising:

providing the cylinder liner with opposite axial ends and formed with a bevel on an inner rim at one or both axial ends of the cylinder liner.

8. The method according to claim 1, further comprising:

providing cut-outs on the liner underside and/or overflow channels by milling or thermal laser-cutting.

9. The method according to claim 1, further comprising:

honing of the inside of the cylinder liner formed.

10. The method of claim 1, wherein the maximum roughness depth of an outer lateral surface of the cylinder liner is 10 μm.

11. The method of claim 1, wherein the cylinder liner formed has a maximum total wall thickness of 0.7 to 2.0 mm.

12. The method of claim 1, further comprising:

inserting the cylinder liner in a cylinder crankcase.

* * * * *